United States Patent [19]

Morelli

[11] 4,330,128

[45] May 18, 1982

[54] GOLF PUTTER WITH REMOVABLE PUTTING ELEMENT

[76] Inventor: Reno T. Morelli, 5415 N. Sheridan, Apt. 5509, Chicago, Ill. 60640

[21] Appl. No.: 207,446

[22] Filed: Nov. 17, 1980

[51] Int. Cl.[3] ..... A63B 53/04

[52] U.S. Cl. ..... 273/173; 273/162 R

[58] Field of Search ..... 273/78, 77 R, 162 R, 273/162 F, 163 R, 164, 167–175, 183 D, 186 R, 186 A, 193 R, 194 R, 194 A, 194 B; 294/141, 158; D21/210, 211, 214, 215, 217–220; 224/249, 251, 269, 271, 274, 918, 919

[56] References Cited

U.S. PATENT DOCUMENTS

| | | | |
|---|---|---|---|
| D. 213,120 | 1/1969 | Mader | D34/5 |
| 1,088,571 | 2/1914 | Heffernan | 273/78 |
| 1,454,267 | 5/1923 | Challis et al. | 273/78 X |
| 2,639,804 | 5/1953 | Merahn | 273/167 F X |
| 3,134,596 | 5/1964 | Boznos | 273/173 |
| 3,218,072 | 11/1965 | Burr | 273/168 X |
| 3,437,341 | 4/1969 | Hasten, Jr. et al. | 273/186 |

FOREIGN PATENT DOCUMENTS

| | | | |
|---|---|---|---|
| 2416 | of 1894 | United Kingdom | 273/173 |
| 9873 | of 1896 | United Kingdom | 273/173 |
| 23691 | of 1906 | United Kingdom | 273/78 |

*Primary Examiner*—Richard J. Apley
*Attorney, Agent, or Firm*—Lee, Smith & Jager

[57] ABSTRACT

A golf putter having, in combination, a putting head and an elongate article, such as a bottle, a portion of which constitutes the putting surface. The putter comprises a generally flat, vertically oriented driving element attached to the putter shaft, with an aperture formed in the driving element of sufficient dimension to accept the elongate article. A receptor, spaced from the driving element by an arm extending between the receptor and the driving element, is shaped to engage one end of the elongate article and retain the article with part of the article being situated within the aperture. That portion of the elongate article extending from the aperture on the side of the driving element opposite from the receptor constitutes the putting surface.

5 Claims, 3 Drawing Figures

28
16
14
20
22
18
24
12
10

16
20
22
26
14
18
24
30

16
18
14
26
28
22
38
24
12

GOLF PUTTER WITH REMOVABLE PUTTING ELEMENT

BACKGROUND OF THE INVENTION

This invention relates to golf putters, and in particular to a golf putter which may be used as a novelty or a training aid and which has an article contained within the putting head which constitutes the putting surface.

In the game of golf, over the years many different golf clubs have been developed to aid in practice of the game or complement a player's skill by helping him assess the various factors which affect play of the game. For example, U.S. Pat. No. 3,437,341 discloses an impact member which may be added to a golf club head in order to accentuate the errant path taken by the golf ball when improperly struck by the golf club. U.S. Pat. No. 3,134,596 discloses a golf club head with a transparent insert to permit the golfer to observe the ground and the turf directly beneath the golf club.

Various shapes have been suggested for golf putters. For example, U.S. Pat. No. Des. 213,120 discloses a golf putter having an integral putting element shaped somewhat in the form of a bottle. The bottle is flattened on one side, the flattened side constituting the putting surface.

SUMMARY OF THE INVENTION

The present invention relates to a golf putter which may constitute a training air or a novelty while the golfer is proceeding on his rounds of the holes at a golf course. The putter comprises, in combination, a putting head and an elongate article, such as a bottle. The putter has a generally flat, vertically oriented driving element attached to the putter shaft, an aperture formed in the driving element of sufficient dimension to permit passage of the bottle therethrough, and means to retain the bottle in the putting head with the base of the bottle located in the aperture and the bottom of the bottle extending outwardly slightly beyond the driving element so that the bottom of the bottle constitutes the putting surface.

The retention means comprises a bottle top receptor shaped to engage the top of the bottle and which is spaced from the driving element in alignment with the axis of the aperture. An arm extends between the bottle top receptor and the driving element to maintain the bottle top receptor in alignment with the axis of the aperture. Preferably, the bottle top receptor comprises a cup-shaped cap having a cavity dimension to grip the top of the bottle.

While a bottle preferably forms a portion of the putting head, other similar elongated articles may be substituted in place of the bottle. For example, if the golf putter is being used as a training aid, a suitably shaped weight might be substituted for the bottle in order to change the swing weight and characteristics of the golf putter.

BRIEF DESCRIPTION OF THE DRAWINGS

The invention is described in greater detail in the following description of the preferred embodiment, taken in conjunction with the drawing, in which.

DESCRIPTION OF THE PREFERRED EMBODIMENTS

Figure 1:
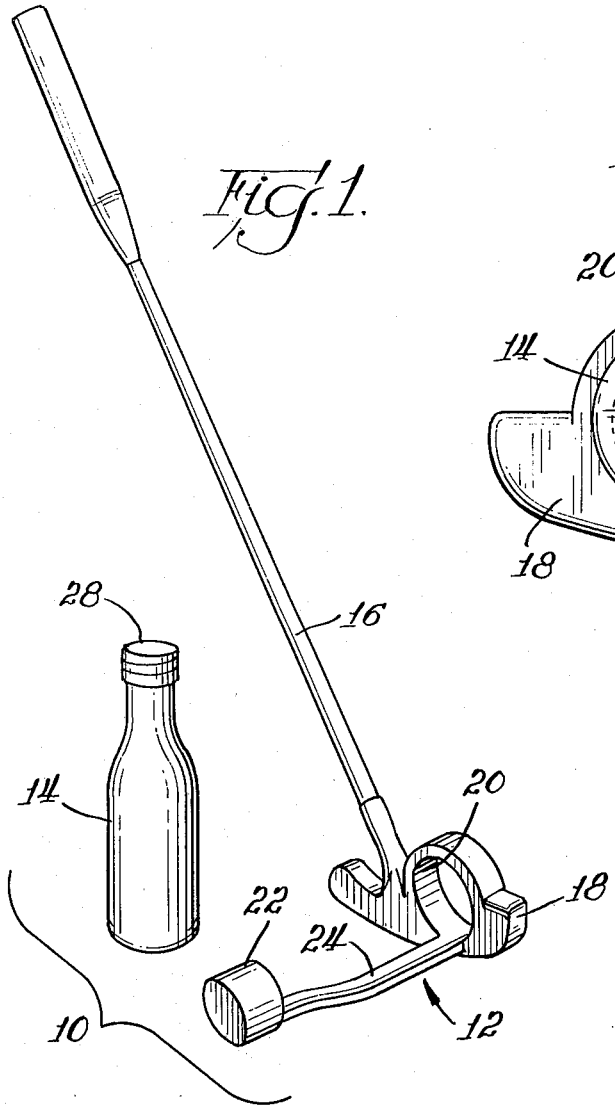
FIG. 1 is a perspective illustration of a golf putter according to the invention with the associated bottle removed and sitting upright for clarity of description.
Figure 3:
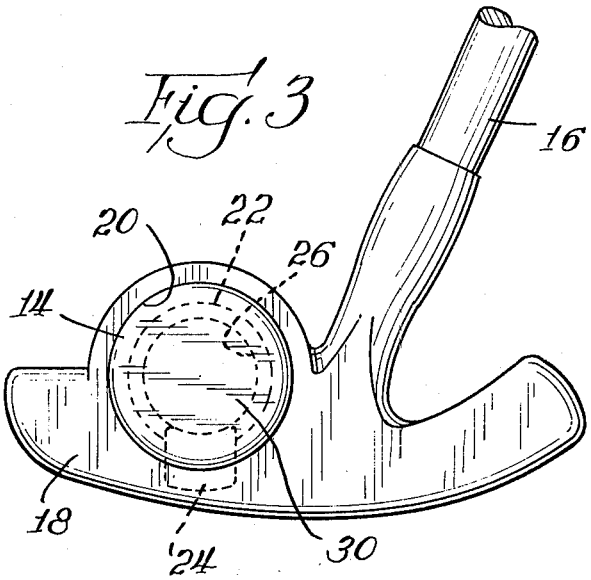
FIG. 3 is a side elevational illustration of the invention looking from the right of FIG. 2.

The golf putter according to the invention is shown generally at 10 in FIG. 1. The putter 10 includes a putter head 12 and an elongate article, such as a bottle, 14. The putter head is attached in a conventional manner to a shaft 16 of the golf putter.

The putter head 12 includes a generally flat, vertically oriented driving element 18 which is attached to the shaft 16. The driving element 18 is sufficiently large to include an aperture 20 dimensioned to permit passage of the bottle 14 therethrough.

Figure 2:
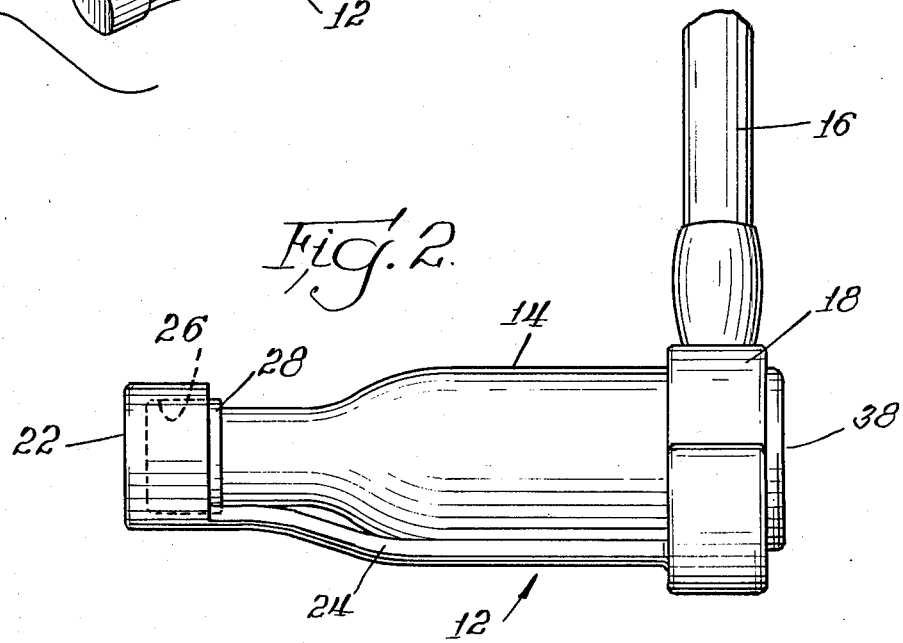
FIG. 2 is an enlarged side elevational illustration of the golf putter having, in combination, a putting head and a bottle.

In order to retain the bottle 14 in the putter head 12 as illustrated in FIG. 2, the putter head 12 includes a receptor 22 which is shaped to engage the top of the bottle 14 and which is spaced from the driving element 18 in alignment with the axis of the aperture 20. The putter head 12 also includes an arm 24 extending between the bottle top receptor 22 and the driving element 18 to maintain the bottle top receptor 22 in alignment with the axis of the aperture 20. The arm 24 is bent as shown so as to maintain the receptor 22 in place and avoid interference with the bottle 14.

As best shown in FIG. 2, the bottle top receptor 22 is a generally cup-shaped cap having a cavity 26 dimensioned to grip the top 28 of the bottle 14. Its shape may change, so long as it aids the retention of the bottle 14 within the aperture 20.

As best illustrated in FIG. 2, the receptor 22, arm 24, and aperture 20 of the putter head 12 are so dimensioned and cooperate such that the base of the bottle 14 is situated in the aperture 20 and the bottom 30 of the bottle extends outwardly from the driving element 18 slightly (to the right in FIG. 2), thereby constituting the putting surface.

During one's golf game, the putter 10, with the bottle 14 inserted within the putter head, can be used for putting strokes. The bottle 14 may be filled with any suitable liquid, such as an alcoholic beverage. The applicant has found that bottles of approximately 1/10 pint, such as those typically served on an airline, are particularly suitable for use in combination with putter head 12.

After the putt has been sunk, as a reward, the golfer may remove the bottle 14 from the putter head 12 and consume the liquid contents of the bottle. The empty bottle may then be returned to the putter head 12, or a full bottle may replace it in order to maintain a consistent weight for the putter 10. Of course, the bottle 14 may be removed and its contents consumed whenever the golfer desires, not just after a successful putt.

Alternatively, as mentioned above, any suitable elongate article may be used in place of the bottle 14. Weights or other devices may be used to impart various swing weights and characteristics to the putter 10.

Various changes may be made to the invention without departing from the spirit thereof or scope of the following claims.

I claim:

1. A golf putter having, in combination, a putting head and a bottle, comprising (a) a generally flat, vertically oriented driving element attached to a putter shaft, (b) an aperture in said driving element of sufficient dimension to permit passage of said bottle therethrough, and (c) means to retain said bottle in said putting head with the base of said bottle being located in said aperture and the bottom of said bottle extending outwardly slightly beyond said driving element, said bottom thereby constituting a putting surface.

2. A golf putter according to claim 1 in which said means to retain comprises a bottle top receptor shaped to engage the top of said bottle and which is spaced from said driving element in alignment with the axis of said aperture.

3. A golf putter according to claim 2 including an arm extending between said bottle top receptor and said driving element to maintain said bottle top receptor in alignment with the axis of said aperture.

4. A golf putter according to claim 2 in which said bottle top receptor comprises a cup-shaped cap having a cavity dimensioned to grip the top of said bottle.

5. A golf putter for use in combination with an elongate article shaped to be removably contained within the putter head and which article constitutes the putting surface when contained within the putter head, the golf putter comprising (a) the putter head consisting of a generally flat, vertically oriented driving element attached to a putter shaft, (b) an aperture in said driving element of sufficient dimension to permit passage of the elongate article therethrough, (c) a receptor shaped to engage one end of the elongate article and retain the elongate article with at least part of the elongate article extends through said aperture and forms the striking face of said putter head, said receptor being rearwardly spaced from said putter head and (d) an arm extending between said receptor and said putter head to maintain said receptor in alignment with the axis of said aperture.

* * * * *